US011284717B2

(12) United States Patent
Bishop et al.

(10) Patent No.: US 11,284,717 B2
(45) Date of Patent: Mar. 29, 2022

(54) STORAGE SYSTEM AND HARDWARE

(71) Applicant: Clairson, Inc., Newark, DE (US)

(72) Inventors: Ryan Barclay Bishop, Ocala, FL (US); Colby Douglas Kudja, Ocala, FL (US)

(73) Assignee: Clairson, Inc., Newark, DE (US)

( * ) Notice: Subject to any disclaimer, the term of this patent is extended or adjusted under 35 U.S.C. 154(b) by 93 days.

(21) Appl. No.: 16/746,335

(22) Filed: Jan. 17, 2020

(65) Prior Publication Data

US 2020/0260867 A1 Aug. 20, 2020

Related U.S. Application Data

(60) Provisional application No. 62/806,209, filed on Feb. 15, 2019.

(51) Int. Cl.
*A47B 57/40* (2006.01)
*A47B 57/34* (2006.01)
(Continued)

(52) U.S. Cl.
CPC ..... *A47B 57/402* (2013.01); *A47B 57/34* (2013.01); *A47B 57/40* (2013.01); *A47B 57/42* (2013.01); *A47B 57/482* (2013.01); *A47B 88/402* (2017.01); *A47B 88/407* (2017.01); *A47B 96/1408* (2013.01)

(58) Field of Classification Search
CPC ..... A47B 57/06; A47B 57/08; A47B 57/10; A47B 57/16; A47B 57/18; A47B 57/20; A47B 57/30; A47B 57/32; A47B 57/34; A47B 57/40; A47B 57/402; A47B 57/404; A47B 57/42; A47B 57/44; A47B 57/46; A47B 57/48; A47B 57/482; A47B 57/485; A47B 57/58; A47B 57/583; A47B 88/407; A47B 88/423; A47B 88/43; A47B 88/402; A47B 2210/01; A47B 96/1408;
(Continued)

(56) References Cited

U.S. PATENT DOCUMENTS 2,772,846 A * 12/1956 Skarjohngl ..... A47B 57/42 248/243
4,401,222 A * 8/1983 Kulikowski ..... A47B 96/067 211/94.01
(Continued)

FOREIGN PATENT DOCUMENTS

DE 1287285 B * 1/1969 ..... A47B 96/061
EP 0069235 A2 * 1/1983 ..... A47B 96/061

*Primary Examiner* — Andrew M Roersma
(74) *Attorney, Agent, or Firm* — Brooks Kushman P.C.

(57) ABSTRACT

A storage system includes at least one upright rail having a front side with notches formed along a length thereof, the at least one upright rail arranged to be attached to an upright support surface. A bracket is arranged to be attached to the at least one upright rail, the bracket including a substrate and a plurality of hooks extending therefrom which are arranged to be received in a corresponding plurality of the notches, the plurality of hooks disposed only along a first portion of the substrate and not along a second portion of the substrate to define an open region of the bracket. The open region allows for attachment of at least one additional hardware member in a shared section with the bracket along the length of the front side of the at least one upright rail.

11 Claims, 8 Drawing Sheets

(51) Int. Cl.

| | |
|---|---|
| ***A47B 88/407*** | (2017.01) |
| ***A47B 88/40*** | (2017.01) |
| ***A47B 57/42*** | (2006.01) |
| ***A47B 57/48*** | (2006.01) |
| ***A47B 96/14*** | (2006.01) |

(58) Field of Classification Search
CPC ... A47B 96/1416; A47B 96/06; A47B 96/061; A47B 96/07; A47B 2220/0002; A47B 2220/0036
See application file for complete search history.

(56) References Cited

U.S. PATENT DOCUMENTS

| | | | | |
|---|---|---|---|---|
| 4,515,494 | A * | 5/1985 | Robilliard | A47B 57/404 403/187 |
| 5,356,106 | A * | 10/1994 | Trotta | A47B 57/482 108/108 |
| 7,506,772 | B2 * | 3/2009 | Chen | A47B 95/008 211/103 |
| 10,098,460 | B1 | 10/2018 | Brinton, Jr. | |
| 2007/0187561 | A1 | 8/2007 | Xayoiphonh | |
| 2008/0302742 | A1 * | 12/2008 | Fulmer | H05K 7/1425 211/59.4 |

* cited by examiner

STORAGE SYSTEM AND HARDWARE

CROSS-REFERENCE TO RELATED APPLICATIONS

This application claims the benefit of U.S. provisional application Ser. No. 62/806,209 filed Feb. 15, 2019, the disclosure of which is hereby incorporated in its entirety by reference herein.

TECHNICAL FIELD

Various embodiments relate to storage systems and bracketry.

BACKGROUND

Various storage systems of the prior art employ upright rails for attachment to an upright wall. The upright rails are employed for supporting shelving brackets, hardware and components upon the upright rails.

SUMMARY

In one or more embodiments, a storage system includes at least one upright rail having a front side with notches formed along a length thereof, the at least one upright rail arranged to be attached to an upright support surface. A bracket is arranged to be attached to the at least one upright rail, the bracket including a substrate and a plurality of hooks extending therefrom which are arranged to be received in a corresponding plurality of the notches, the plurality of hooks disposed only along a first portion of the substrate and not along a second portion of the substrate to define an open region of the bracket. The open region allows for attachment of at least one additional hardware member in a shared section with the bracket along the length of the front side of the at least one upright rail.

In one or more embodiments, a storage system includes at least one upright rail having a front side with notches formed along a length thereof, the at least one upright rail arranged to be attached to an upright support surface. A bracket is arranged to be attached to the at least one upright rail and has a longitudinal axis, the bracket including a mounting plate and a plurality of hooks extending therefrom which are arranged to be received in a corresponding plurality of the notches, the mounting plate having at least one mounting slot formed therein in an orientation transverse to the longitudinal axis. A subassembly is mounted to the bracket via a fastener received in the at least one mounting slot, wherein the at least one mounting slot permits adjustability of a position of the fastener to customize a transverse position of the subassembly with respect to the at least one upright rail.

In one or more embodiments, a method for installing a storage system includes providing an upright rail having a front side with notches formed along a length thereof, and installing the upright rail upon an upright support surface. The method further includes providing a bracket including a mounting plate and a plurality of hooks extending therefrom, the bracket having a longitudinal axis and the mounting plate having at least one mounting slot formed therein in an orientation transverse to the longitudinal axis. The method further includes attaching the bracket to the upright rail by engaging the plurality of spaced hooks with the notches, mounting a subassembly to the bracket via a fastener received in the at least one mounting slot, and adjusting a position of the fastener in the at least one mounting slot to customize a transverse position of the subassembly with respect to the upright rail.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
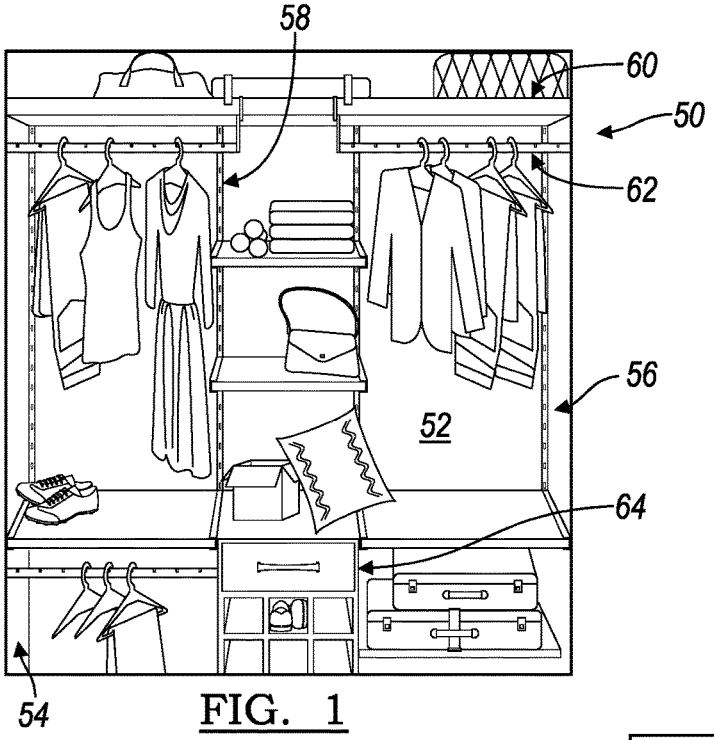
FIG. 1 is a front perspective view of a closet with a storage system according to an embodiment.

FIG. 1 illustrates a storage system 50 according to an embodiment. In the depicted embodiment, the storage system 50 is installed in a closet having an upright support surface, such as a central support wall 52, and a pair of side walls 54, 56. Although a closet environment is depicted, various environments with at least one wall can be utilized to install various storage systems, such as the storage system 50 depicted in FIG. 1.

The storage system 50 includes a plurality of upright rails 58, often referred to as standards 58. The standards 58 may be stamped metal rails that are fastened to the support wall 52 for attaching various subassemblies to the support wall 52. In FIG. 1, the storage system 50 is depicted with some subassemblies, for example, shelving 60, clothing rods 62, drawers 64, and the like. Each of these various subassemblies 60, 62, 64 are mounted to the standards 58.

In the prior art, when a pair of subassemblies are aligned adjacent to one another, such as a drawer 64 adjacent to another subassembly 60, 62, 64, one standard 58 does not provide adequate mounting area for both subassemblies 64, and 60, 62, or 64. Therefore, it is common in the prior art to install a pair of adjacent standards 58 to the support wall 52 for supporting the adjacent subassemblies 64, and 60, 62, or 64. The storage system 50 disclosed herein avoids the requirement for adjacently paired standards 58 so that a plurality of standards 58 can be installed to support wall 52 individually and spaced apart from one another.

Figure 2:
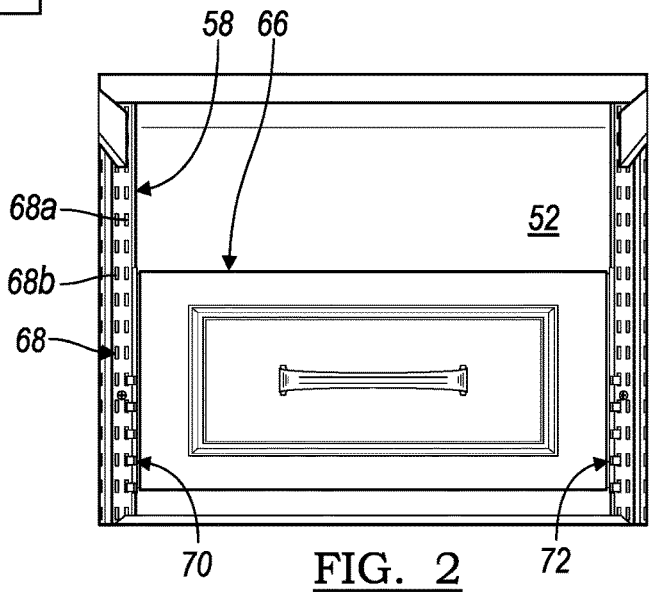
FIG. 2 is an enlarged front perspective view of a subassembly of a storage system according to an embodiment.
Figure 3:
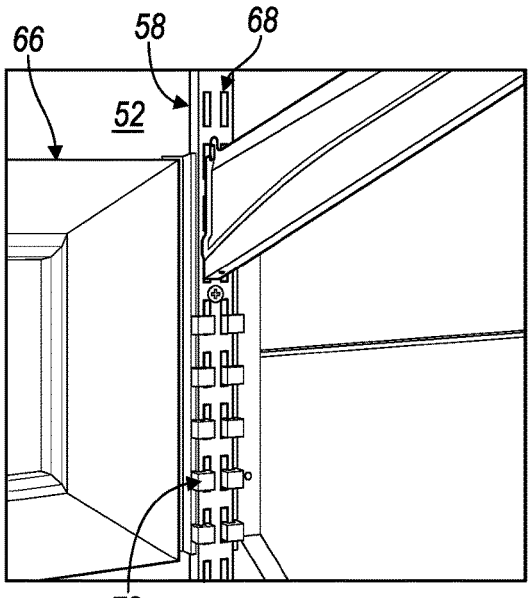
FIG. 3 is another enlarged front perspective view of the subassembly of FIG. 2.

FIGS. 2 and 3 illustrate a drawer subassembly 66 mounted to a pair of spaced apart standards 58. Each of the standards 58 is fastened to a support wall 52. The standards 58 have a depth to space apart from the wall 52. The standards 58 both include a plurality of notches 68 formed along a length of the standards 58. In one or more embodiments, the notches 68 are formed in a linear array with two columns and multiple rows, resulting in a series of paired notches 68. The array of notches 68 provides adjustability to the storage system 50 by offering various attachment options.

The drawer subassembly 66 includes a pair of brackets 70, 72 that are each sized to engage and mount the drawer subassembly 66 upon the pair of standards 58. The brackets 70, 72 may be formed from stamped sheet metal or any suitable material. Each of the brackets 70, 72 engage an inner series or column 68*a* of notches 68 of each standard 58 to leave an outer series or column 68*b* of notches 68 open for attachment of additional hardware. By leaving the outer column 68*b* of notches 68 open, the additional adjacent standard 58 of the prior art installations is omitted, as the outer column 68*b* of notches is free to serve as an inner column of notches for an adjacent subassembly, as illustrated in FIG. 3.

Figure 4:
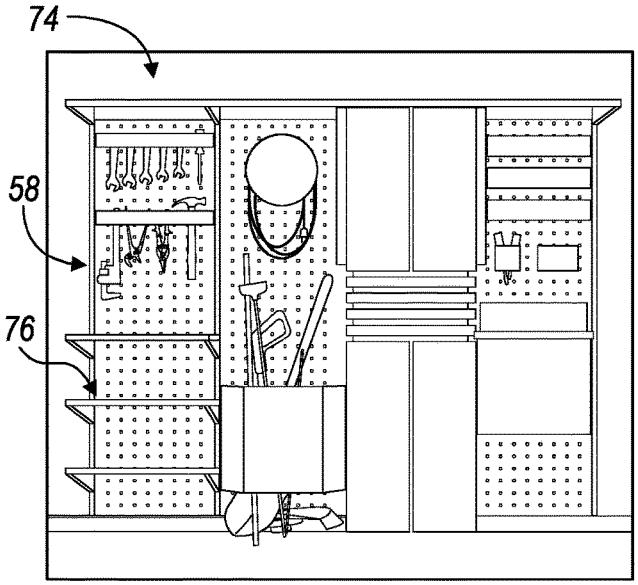
FIG. 4 is a front perspective view of a storage system according to another embodiment.
Figure 5:
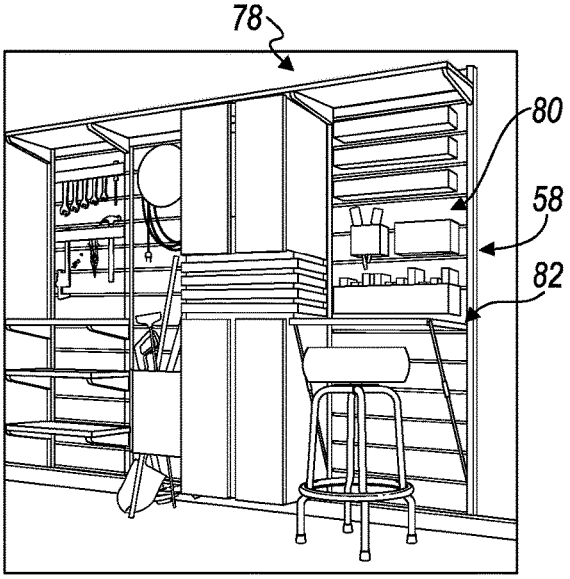
FIG. 5 is a front perspective view of a storage system according to another embodiment.
Figure 6:
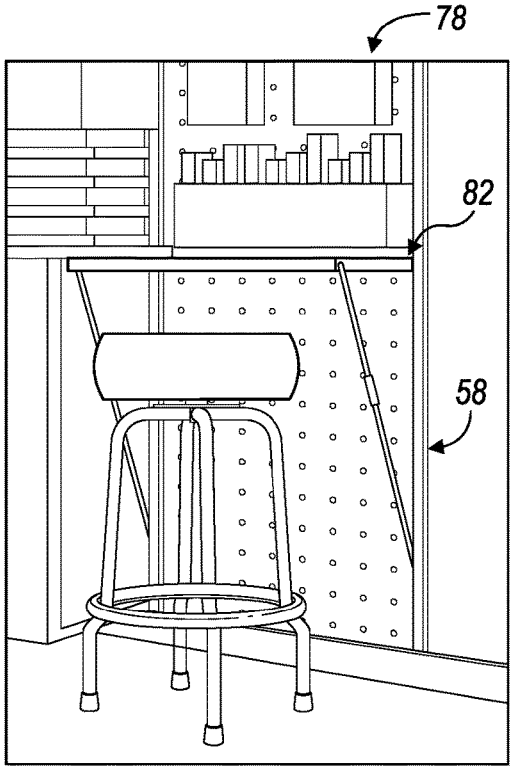
FIG. 6 is an enlarged front perspective view of a subassembly of the storage system of FIG. 5.

Various storage system environments may employ the teachings of the closet storage system 50. For example, the storage system 50 may be employed in pantries, laundry rooms, garages, and the like. Additionally, various hardware and subassemblies are contemplated for utilization with the storage system. FIG. 4 illustrates a storage system 74, which also incorporates pegboards 76 installed to the standards 58, according to an embodiment. FIGS. 5 and 6 illustrate a storage system 78, wherein the standards 58 support back panels 80 and a table subassembly 82. Various accessories and subassemblies may be combined, such as baskets, hooks, undershelf attachments, lighting, and the like.

Figure 7:
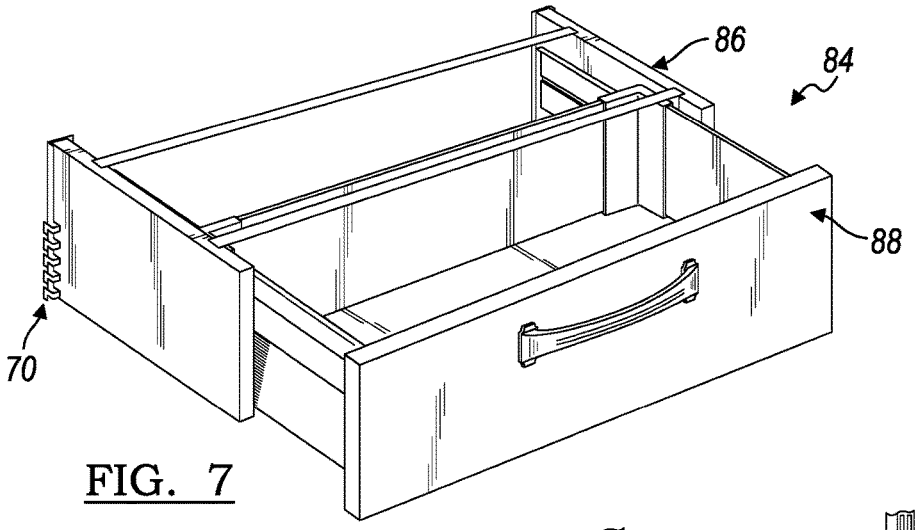
FIG. 7 is an enlarged front perspective view of a subassembly of a storage system according to another embodiment.
Figure 8:
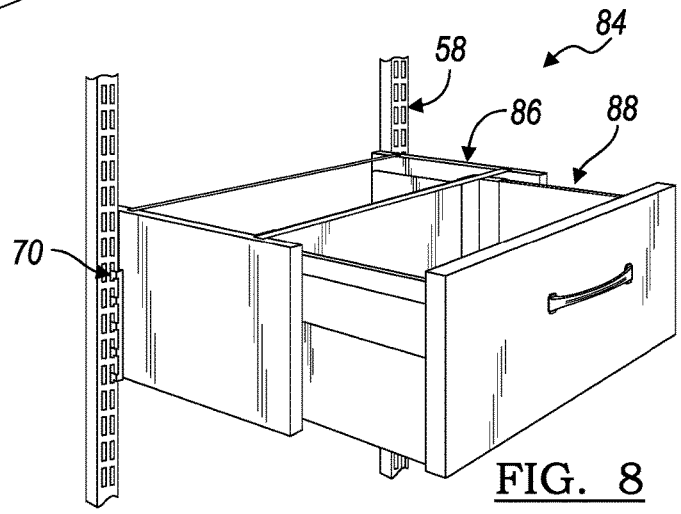
FIG. 8 is another enlarged front perspective view of the subassembly of FIG. 7.

FIGS. 7 and 8 illustrate another drawer subassembly 84 according to an embodiment. The drawer subassembly 84 includes a drawer receptacle frame 86 which may be mounted to the pair of brackets 70, 72 (not shown). The brackets 70, 72 may be installed upon the standards 58 as shown in FIG. 8. A drawer 88 is mounted to the frame 86 for limited longitudinal translation relative to the frame 86 for providing the drawer 88 upon the wall 52 of the storage system.

Figure 9:
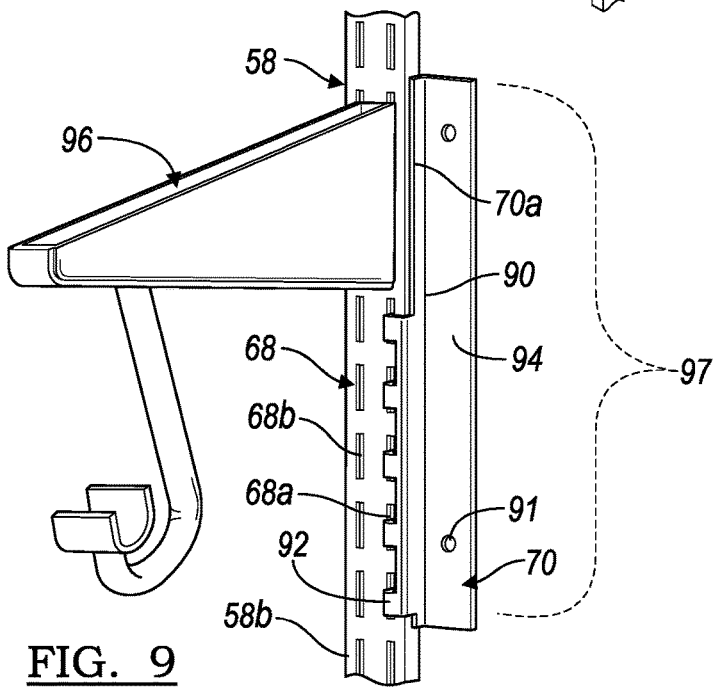
FIG. 9 is an enlarged front perspective view of a subassembly of a storage system according to another embodiment.
Figure 10:
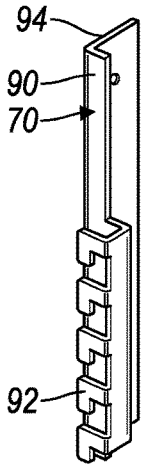
FIG. 10 is a front and left side perspective view of a bracket of a storage system according to another embodiment.
Figure 15:
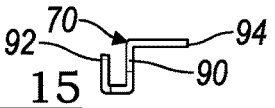
FIG. 15 is a top end view of the bracket of FIG. 10.
Figure 11:
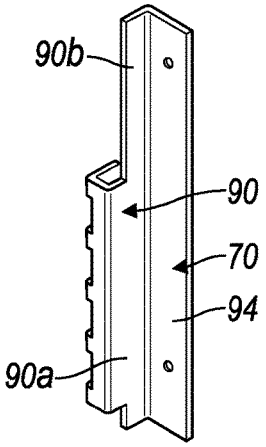
FIG. 11 is a front and right side perspective view of the bracket of FIG. 10.
Figure 12:
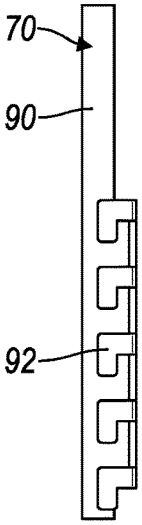
FIG. 12 is a left side elevation view of the bracket of FIG. 10.
Figure 13:
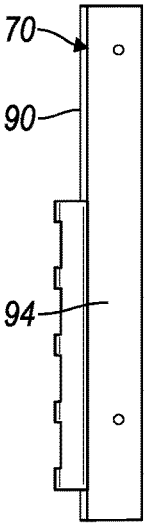
FIG. 13 is front side elevation view of the bracket of FIG. 10.
Figure 14:
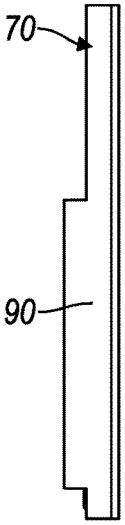
FIG. 14 is a right side elevation view of the bracket of FIG. 10.
Figure 16:
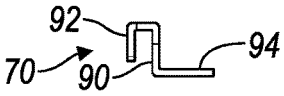
FIG. 16 is a bottom end view of the bracket of FIG. 10.
Figure 17:
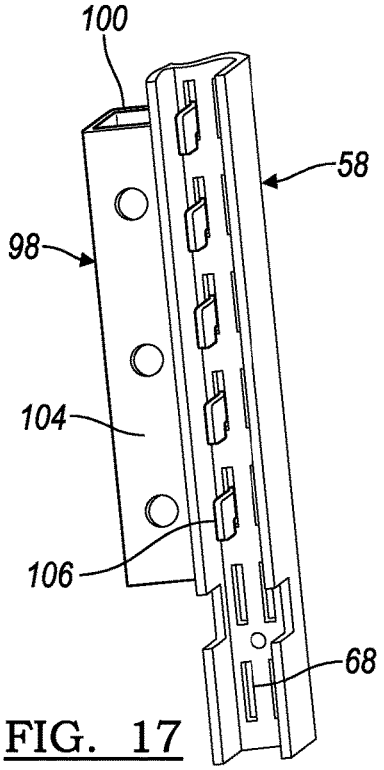
FIG. 17 is a rear perspective view of a subassembly of a storage system according to an embodiment.

FIG. 9 illustrates one of the brackets 70 installed to the standard 58 without a drawer subassembly. FIGS. 10-16 also illustrate various views of the bracket 70. The bracket 70 is a left side bracket 70, wherein the right side bracket 72 is a mirror image of the left side bracket 70. The bracket 70 includes a substrate 90 that is arranged to extend along an inner lateral side 58*a* of the standard 58.

A plurality of hooks 92 extend from the substrate 90 and are arranged to extend across a front side 58*b* of the standard 58 and into a corresponding plurality of the notches 68 (e.g., inner series 68*a*). According to an embodiment, the hooks 92 do not extend beyond one half of a width of the standard 58 in order to provide clearance for attachment to the opposed plurality of notches 68 (e.g., outer series 68*b*). In this way, a pair of the brackets 70, 72 may be mounted to the standard 58 in both the inner series 68*a* and outer series 68*b* of notches 68 along a common region lengthwise along the standard 58. The hooks 92 are incrementally spaced to match a spacing of the notches 68 for concurrent attachment of multiple hooks 92 in the notches 68. For the given exemplary embodiment, five hooks 92 and notches 68 are utilized for connecting the bracket 70 to the standard 58, although not limited to this number.

A mounting plate 94 extends from the substrate 90 with a mounting pattern of mounting apertures 91 for attaching accessories, hardware, subassemblies and the like. According to an embodiment, the mounting plate 94 may extend generally orthogonally to the substrate 90. The substrate 90 extends along a depth of the standard 58 so that the mounting plate 94 is arranged to abut the support wall 52 to add structural integrity to the bracket 70 and any associated hardware, subassembly, or the like. Thus, the hooks 92 and the substrate 90 are arranged to wrap around a lateral side 58*a* and partially over a front side 58*b* of the standard 58.

According to an embodiment, the hooks 92 may be disposed only along a limited length of the bracket 70. For example, with reference to FIG. 11, the hooks 92 may be disposed only along a first portion 90*a* (e.g. lower portion) of the substrate 90 and not on a second portion 90*b* (e.g. upper portion) of the substrate 90, thus leaving a clearance or open region along the bracket 70, such as upper region 70*a*. Referring again to FIG. 9, this clearance on the front side 58*b* of the standard 58 permits passage and attachment of an additional hardware member, such as a shelf bracket 96, while still maintaining the overall length of the substrate 90 and the mounting plate 94. This, in turn, maintains the structural integrity of the bracket 70 and provides greater surface area engagement of the substrate 90 with the lateral side 58*a* of the standard 58 and engagement of the mounting plate 94 with the support wall 52. Accordingly, a pair of brackets 70, 72 and a shelf bracket 96 may occupy a shared, common lengthwise section 97 along a single standard 58.

FIGS. 17-25 illustrate a bracket 98 according to another embodiment. The bracket 98 is illustrated assembled to a standard 58 in FIGS. 17 and 18, and disassembled in FIGS. 19-25. Instead of having a bracket 70, 72 that is dedicated to a particular side, the bracket 98 is symmetrical for use on either side of a subassembly.

The bracket 98 is formed from a channel with a mounting plate 100, a web 102 and a support flange 104. A plurality of dual-sided hooks 106 extend from the mounting plate 100 to be received and attach in the notches 68 of the standard 58, wherein the hooks 106 may extend generally orthogonally from the mounting flange 100. The mounting plate 100 includes a mounting pattern of mounting apertures 101 for attaching a subassembly or hardware. The web 102 extends rearward from the mounting plate 100 in the depth direction of the standard 58, and may be generally orthogonal to the mounting plate 100 and generally parallel to a lateral side 58*a* of the standard 58. The support flange 104 extends from the web 102 (e.g. generally orthogonally) and is arranged to engage the support wall 52 and distribute loads from the subassembly upon the bracket 98 to the wall 52.

Figure 18:
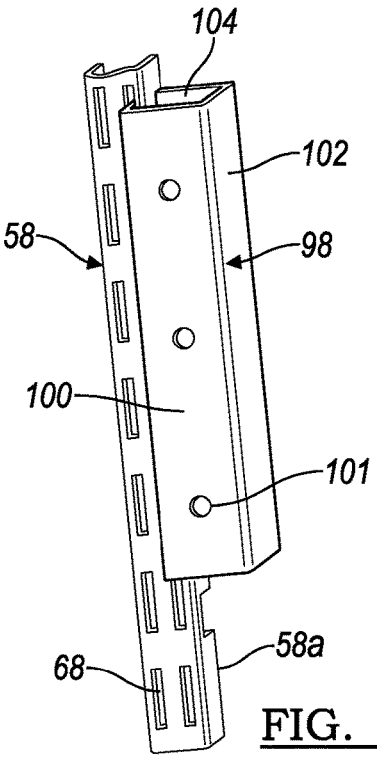
FIG. 18 is a front perspective view of the subassembly of FIG. 17.
Figure 19:
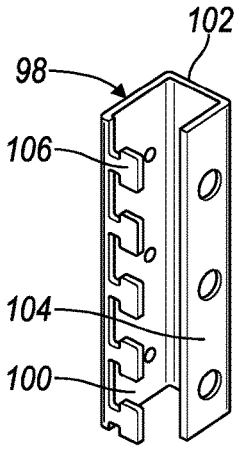
FIG. 19 is a rear and left side perspective view of a bracket of a storage system according to an embodiment.
Figure 24:
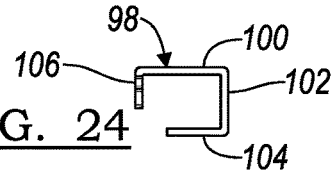
FIG. 24 is a top end view of the bracket of FIG. 19.
Figure 20:
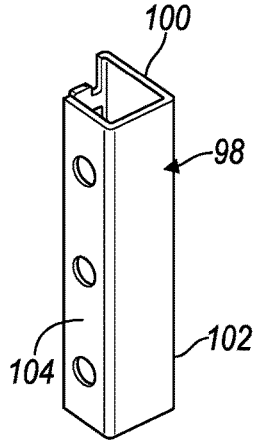
FIG. 20 is a rear and right side perspective view of the bracket of FIG. 19.
Figure 21:
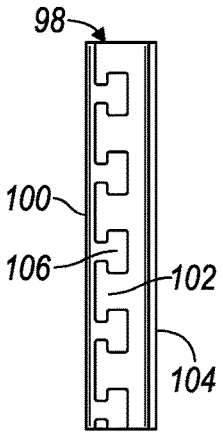
FIG. 21 is a left side elevation view of the bracket of FIG. 19.
Figure 22:
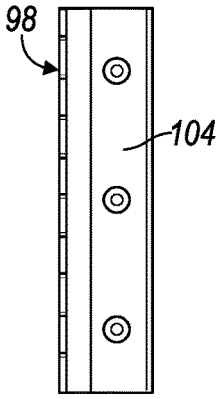
FIG. 22 is a rear side elevation view of the bracket of FIG. 19.
Figure 23:
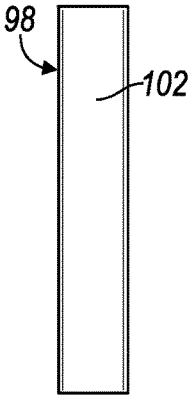
FIG. 23 is a right side elevation view of the bracket of FIG. 19.
Figure 25:
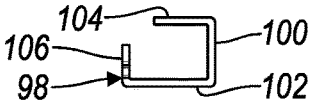
FIG. 25 is a bottom end view of the bracket of FIG. 19.
Figure 26:
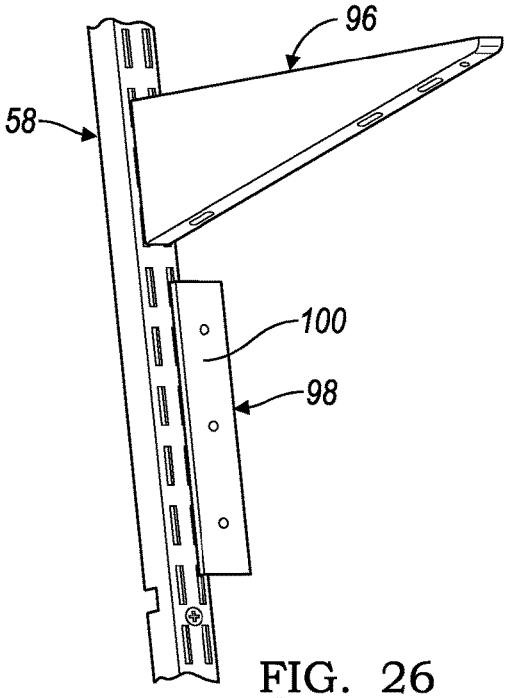
FIG. 26 is front perspective view of a subassembly of a storage system according to an embodiment.
Figure 27:
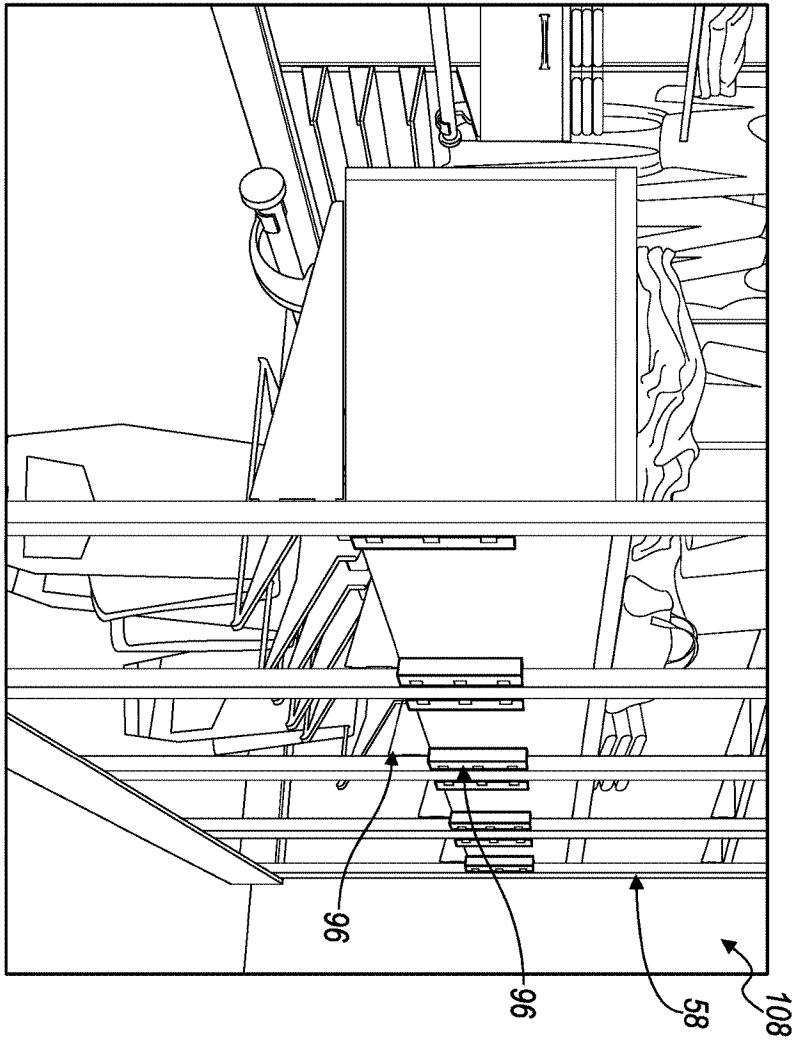
FIG. 27 is a rear perspective view of a storage system according to an embodiment, illustrated without an upright support surface.
Figure 28:
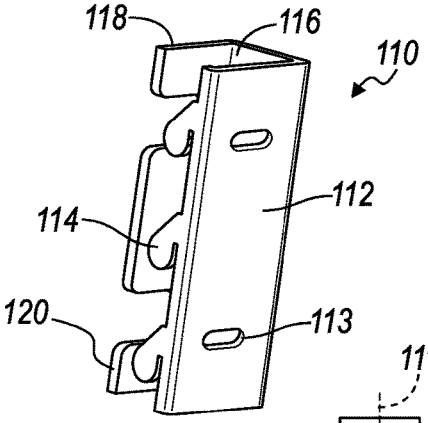
FIG. 28 is a front and left perspective view of a bracket of a storage system according to an embodiment.
Figure 33:
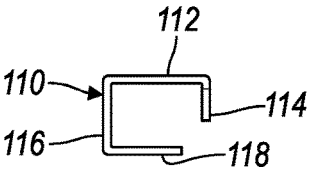
FIG. 33 is a top end view of the bracket of FIG. 28.
Figure 29:
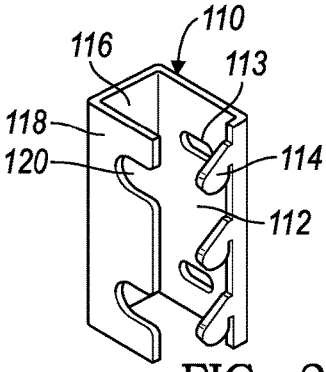
FIG. 29 is a rear and left perspective view of the bracket of FIG. 28.
Figure 30:
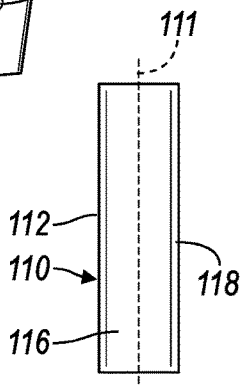
FIG. 30 is a right side elevation view of the bracket of FIG. 28.
Figure 31:
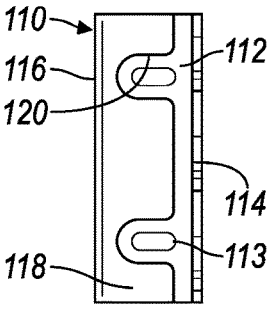
FIG. 31 is a rear side elevation view of the bracket of FIG. 28.
Figure 32:
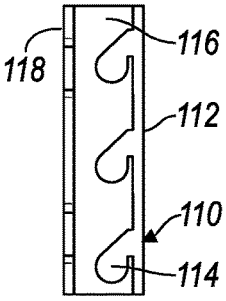
FIG. 32 is a left side elevation view of the bracket of FIG. 28.

In FIG. 18, the bracket 98 is shown attached to a right side of the standard 58. In order to attach the bracket 98 to the left side of the standard 58, the bracket 98 can simply be rotated about a horizontal axis so that the ends of the bracket 98 are reversed. FIG. 26 illustrates the bracket 98 mounted to the standard 58 below the shelf bracket 96. FIG. 27 illustrates a storage system 108 with the support wall 52 removed. In the storage system 108, the bracket 98 is mounted to the standard 58 above the shelf bracket 96.

FIGS. 28-33 illustrate another bracket 110 according to an embodiment. Unlike the prior embodiment, the bracket 110 is specific to a left side, and a corresponding right side bracket is provided which is a mirror image thereof. The bracket 110 has a longitudinal axis 111 (FIG. 30) and includes a mounting plate 112 with a mounting pattern of mounting slots 113 for fastening to other hardware or a subassembly. The slots 113 may have an orientation transverse to the longitudinal axis 111 and permit a limited range of transverse adjustability of the associated subassembly, as described further below. A plurality of hooks 114 extend at an angle from the mounting plate 112, and may extend generally orthogonally from the mounting plate 112. The hooks 114 are arranged to be received by and attach to the notches 68 of the standard 58. A web 116 extends in a depth direction of the standard 58, generally orthogonally from the mounting plate 112. A support flange 118 extends generally orthogonally from the web 116 and is arranged to engage the support wall 52 and distribute the applicable loading. Cutouts 120 may be provided in the support flange 118 for clearance during installation of fasteners through the mounting plate 112 and into the associated subassembly.

Figure 34:
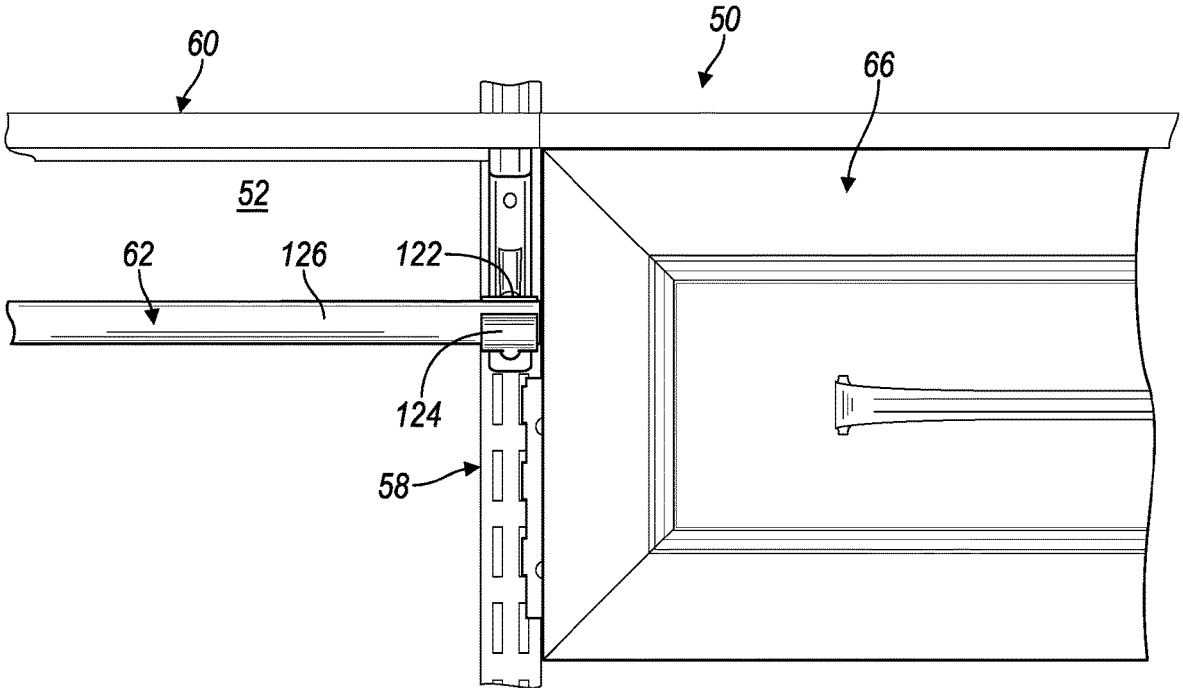
FIG. 34 is an enlarged front perspective view of a region of the storage system according to another embodiment.
Figure 35:
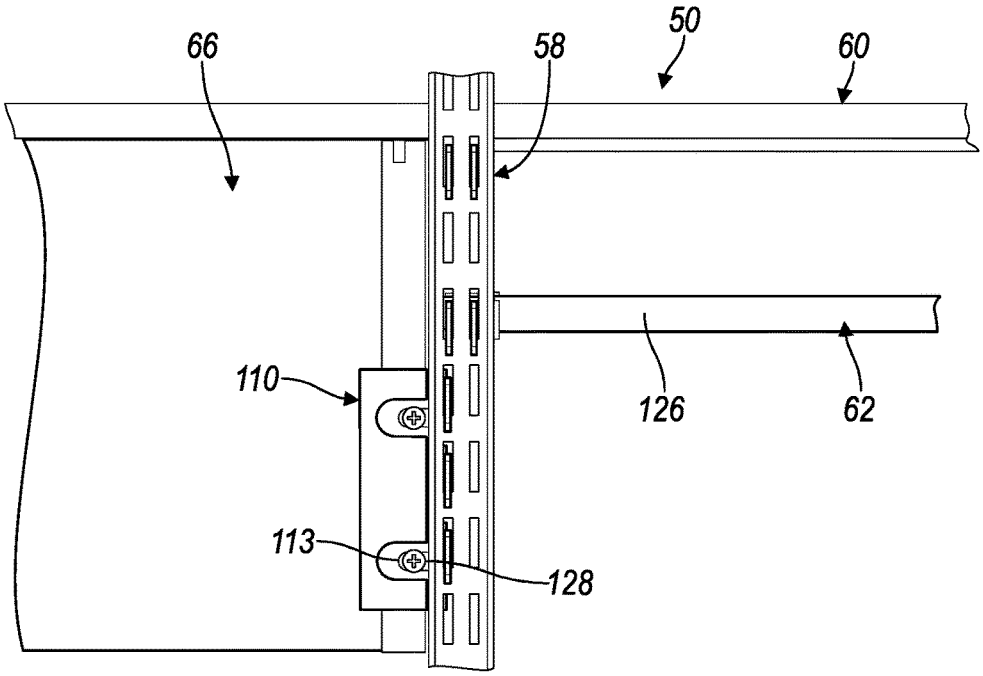
FIG. 35 is an enlarged rear perspective view of the region of the storage system of FIG. 34.

FIGS. 34 and 35 illustrate an example of a region of the storage system 50, wherein a drawer subassembly 66 is installed to the standard 58 adjacent to a clothing rod subassembly 62. FIG. 34 is a front view of the region, wherein FIG. 35 is a rear view with the support wall 52 removed. A shelf subassembly 60 is provided over the drawer subassembly 66 and the clothing rod subassembly 62. Each of the depicted subassemblies 66, 62, 60 are mounted to the single standard 58. As illustrated in FIG. 34, the clothing rod subassembly 62 may include a clothing rod bracket 122 with an end cap 124 for a clothing rod 126. In this arrangement, the end cap 124 and the conventional clothing rod bracket 122 extend to and beyond a center of the standard 58.

As illustrated in FIG. 35, the drawer subassembly 66 is mounted to the standard 58 by the bracket 110. The bracket 110 is mounted to the standard 58, and a pair of fasteners, such as screws 128, are installed through the slots 113 into the drawer subassembly 66. The bracket 110 is installed relatively outboard, or shifted to the right in FIG. 35, so that the drawer subassembly 66 is oriented relatively outboard relative to the standard 58 for spacing away from the standard 58, and consequently away from the clothing rod subassembly 62. This flexibility of the brackets 110 offered by the slots 113 permits clearance for components such as the clothing rod bracket 122 (FIG. 34) of the clothing rod subassembly 62 to be installed adjacent to the drawer subassembly 66.

Figure 36:
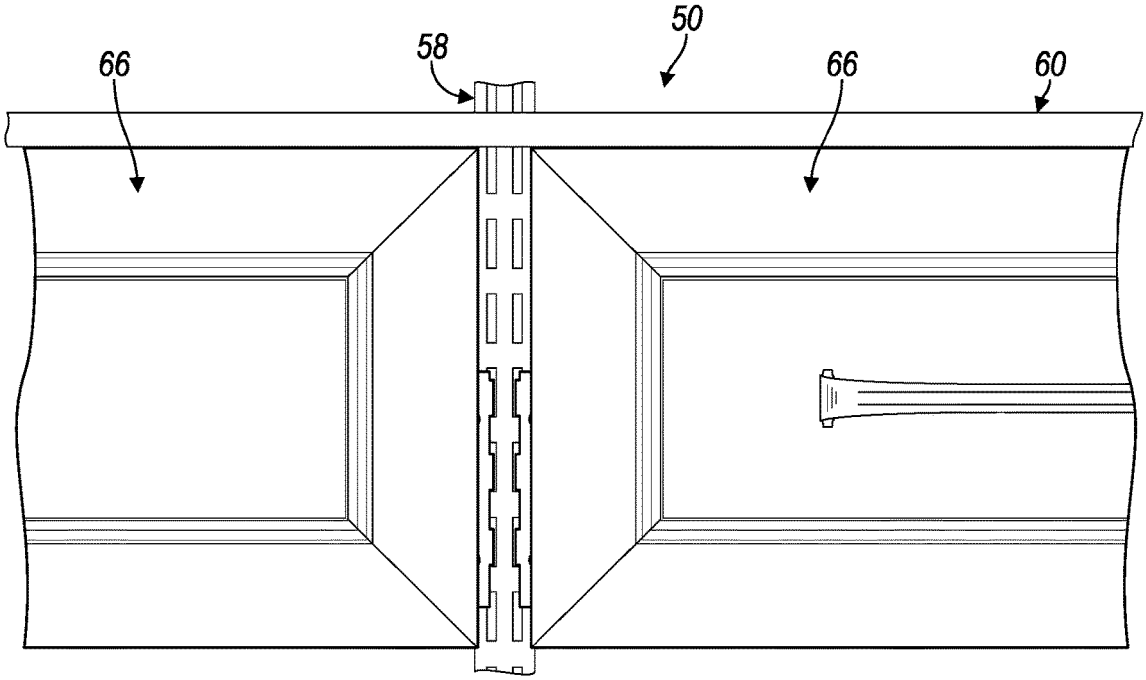
FIG. 36 is an enlarged front perspective view of another region of the storage system according to another embodiment.
Figure 37:
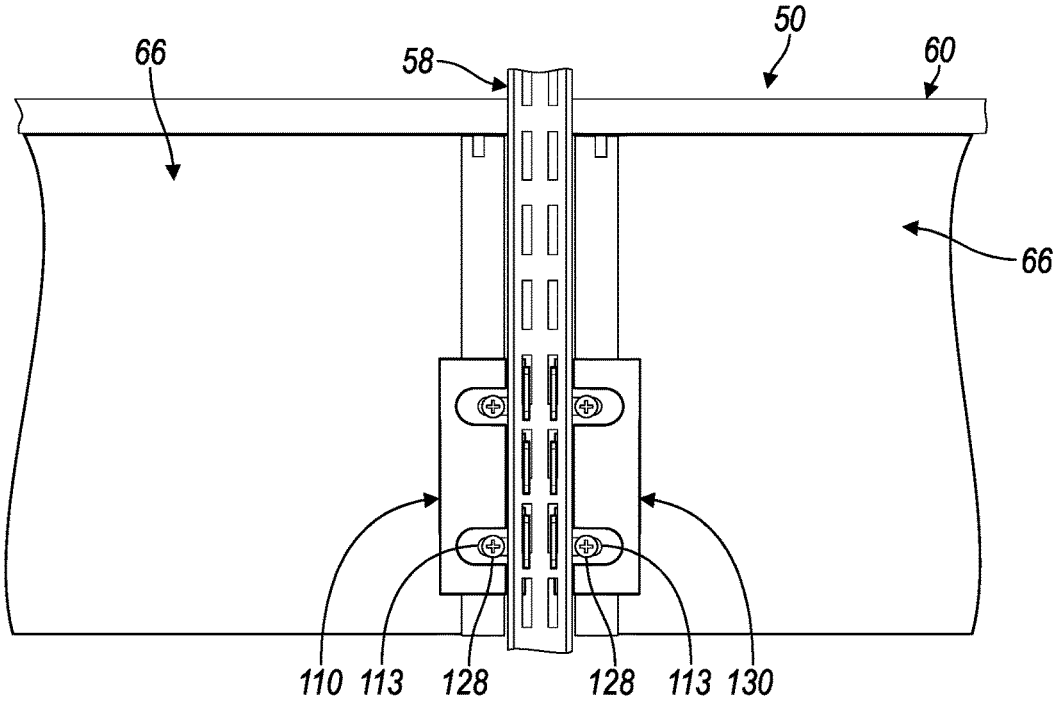
FIG. 37 is an enlarged rear perspective view of the region of the storage system of FIG. 36.

FIGS. 36 and 37 illustrate another region of the storage system 50 with a pair of drawer subassemblies 66 mounted adjacent to one another on a single standard 58. A shelving subassembly 60 is also provided over the drawer subassemblies 66 and mounted to the single standard 58.

Referring now to FIG. 37, the drawer subassembly 66 on the left is mounted to the standard 58 with a bracket 110. The drawer subassembly 66 on the right in FIG. 37 is mounted to the standard with a bracket 130. The bracket 130 is a mirror image of the bracket 110.

The drawer subassemblies 66 are mounted to the respective brackets 110, 130 by fasteners 128 in the slots 113. The flexibility of this fastened arrangement permits both brackets 110, 130 to be fastened relatively inboard upon the drawer subassemblies 66. In other words, in FIG. 37, the bracket 110 on the left is shifted to the left, and the bracket 130 on the right is shifted to the right, as permitted by the slots 113. Such adjustment can pull the drawer subassemblies 66 closer together for a more uniform and consistent look across the adjacent drawer subassemblies 66. In this way, the position of the subassemblies 66 with respect to the standard 58 can be customized.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A storage system, comprising:

at least one upright rail having a front side with notches formed along a length thereof, the at least one upright rail arranged to be attached to an upright support surface;

a bracket arranged to be attached to the at least one upright rail and having a longitudinal axis, the bracket including a mounting plate and a plurality of hooks extending therefrom which are arranged to be received in a corresponding plurality of the notches, the mounting plate having at least one mounting slot formed therein in an orientation transverse to the longitudinal axis, wherein the bracket further includes a web connected to the mounting plate, and a support flange connected to the web, wherein the web extends along a depth of the at least one upright rail so that the support flange is arranged to abut the upright support surface; and a subassembly mounted to the bracket via a fastener received in the at least one mounting slot, wherein the at least one mounting slot permits adjustability of a position of the fastener to customize a transverse position of the subassembly with respect to the at least one upright rail.

2. The storage system of claim 1, wherein the support flange includes at least one transverse cutout arranged to receive the fastener.

3. The storage system of claim 1, wherein the notches are formed in a linear array with two columns and multiple rows to define a series of paired said notches.

4. The storage system of claim 1, wherein the mounting plate does not extend beyond one half of a width of the front side of the at least one upright rail.

5. The storage system of claim 1, wherein the subassembly includes a drawer subassembly having a drawer receptacle frame arranged to be mounted to the bracket, and a drawer mounted to the frame for limited longitudinal translation relative to the frame.

6. A method for installing a storage system, comprising:

providing an upright rail having a front side with notches formed along a length thereof;

installing the upright rail upon an upright support surface;

providing a bracket including a mounting plate and a plurality of hooks extending therefrom, the bracket having a longitudinal axis and the mounting plate having at least one mounting slot formed therein in an orientation transverse to the longitudinal axis, wherein the bracket further includes a web connected to the mounting plate, and a support flange connected to the web, wherein the web extends along a depth of the upright rail so that the support flange is arranged to abut the upright support surface;

attaching the bracket to the upright rail by engaging the plurality of hooks with the notches;

mounting a subassembly to the bracket via a fastener received in the at least one mounting slot; and adjusting a position of the fastener in the at least one mounting slot to customize a transverse position of the subassembly with respect to the upright rail.

7. The method of claim 6, wherein the notches are formed in a linear array with two columns and multiple rows to define a series of paired said notches in an inner column and an outer column.

8. The method of claim 7, wherein attaching the bracket includes engaging the inner column of the notches without obscuring the outer column of the notches.

9. The method of claim 7, wherein attaching the bracket includes attaching a first said bracket to the inner column of notches and attaching a second said bracket to the outer column of notches along a common lengthwise region of the upright rail.

10. The method of claim 6, wherein the subassembly includes a drawer subassembly having a drawer receptacle frame arranged to be mounted to the bracket, and a drawer mounted to the frame for limited longitudinal translation relative to the frame.

11. The method of claim 6, wherein the support flange includes at least one transverse cutout for receiving the fastener.

* * * * *